US011963583B2

(12) United States Patent
McGonigal

(10) Patent No.: US 11,963,583 B2
(45) Date of Patent: Apr. 23, 2024

(54) OVERSHOE WALKING CORRECTOR

(71) Applicant: Gail Colleen McGonigal, Vancouver (CA)

(72) Inventor: Gail Colleen McGonigal, Vancouver (CA)

( * ) Notice: Subject to any disclaimer, the term of this patent is extended or adjusted under 35 U.S.C. 154(b) by 0 days.

(21) Appl. No.: 16/789,351

(22) Filed: Feb. 12, 2020

(65) Prior Publication Data

US 2022/0264990 A1 Aug. 25, 2022

(51) Int. Cl.
*A43B 7/14* (2022.01)

(52) U.S. Cl.
CPC ..... *A43B 7/14* (2013.01)

(58) Field of Classification Search
CPC ..... A43B 7/14
See application file for complete search history.

(56) References Cited

U.S. PATENT DOCUMENTS 5,974,698 A * 11/1999 Nash ..... A43B 3/16 36/7.1 R
11,000,399 B2 * 5/2021 Darby, II ..... A43B 7/141
2002/0178621 A1 * 12/2002 Darby ..... A43B 7/1415 36/110
2005/0262740 A1 * 12/2005 Salvatelli ..... A43B 13/146 36/43
2008/0022555 A1 * 1/2008 Mor ..... A43B 3/16 36/62
2008/0184592 A1 * 8/2008 Brie ..... A43B 3/18 36/7.1 R
2008/0263900 A1 * 10/2008 Determe ..... A43B 13/10 36/110
2010/0077638 A1 * 4/2010 Simms ..... A43B 5/185 36/7.1 R
2011/0078923 A1 * 4/2011 Bartholet ..... A43B 21/26 36/92
2014/0325875 A1 * 11/2014 Lee ..... A43B 3/16 36/73

(Continued)

*Primary Examiner* — Joshua T Kennedy

(57) ABSTRACT

The Overshoe Walking Correctors (OWCs) are a medical walking device to go over a user's feet and shoes and changes the shape in the base of their current walking shoes for correcting gait. They need only be used by the obese and overweight population, who suffer limited mobility in their skeletal joints, due to the burden of weight they are carry on their bodies. The device was designed by Gail McGonigal an Occupational Therapist, who discovered the concept after falling on concrete severely bruising but not breaking her hip, due to a daily intake of oral calcium. She was only able to walk in rocker shoes containing no weight bearing capacity. Gail immediately understood how this concept will help the obese population improve their mobility in gait. She has designed the Overshoe Walking Correctors for all overweight people to wear, so they will feel no more pain in gait. The device is designed to have immediate and positive affects on their health, so the overweight population are encouraged to increase their physical mobility, while reducing the amount of sedentary sitting they perform on a daily basis. The intention is to relieve the pressure on acute medical services in all western populations, where obesity is a leading cause of chronic health issues needing constant attention by the medical practioners in acute care hospitals.

2 Claims, 5 Drawing Sheets

(56) References Cited

U.S. PATENT DOCUMENTS

| | | | | |
|---|---|---|---|---|
| 2019/0116924 | A1* | 4/2019 | Darby | A43B 3/128 |
| 2019/0116925 | A1* | 4/2019 | Darby | B29D 35/142 |
| 2021/0085025 | A1* | 3/2021 | Geis | A43B 13/145 |

* cited by examiner

Fig 1: Photographs of Very Bruised Hip over 4 Days, Walking in Rocker Based Shoes
1
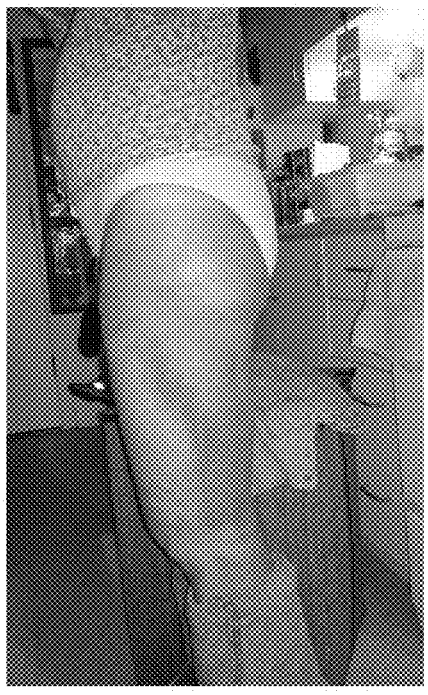
Prior Art
3
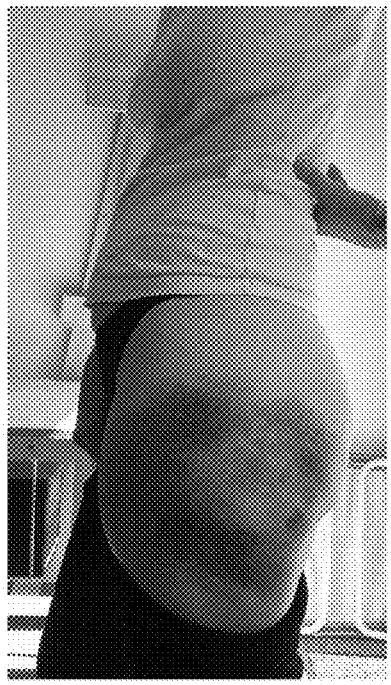
Prior Art
2
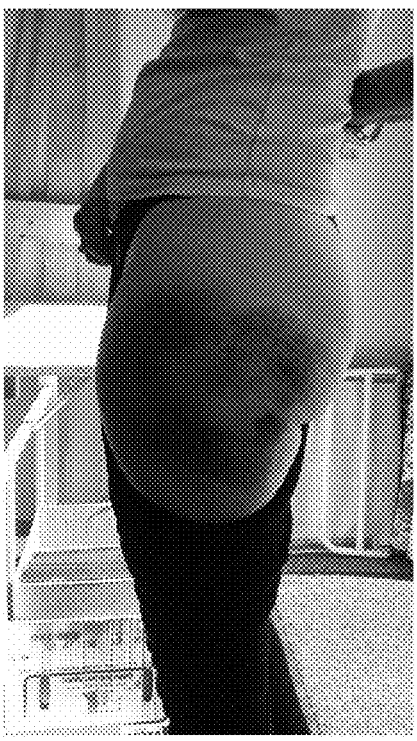
Prior Art
4
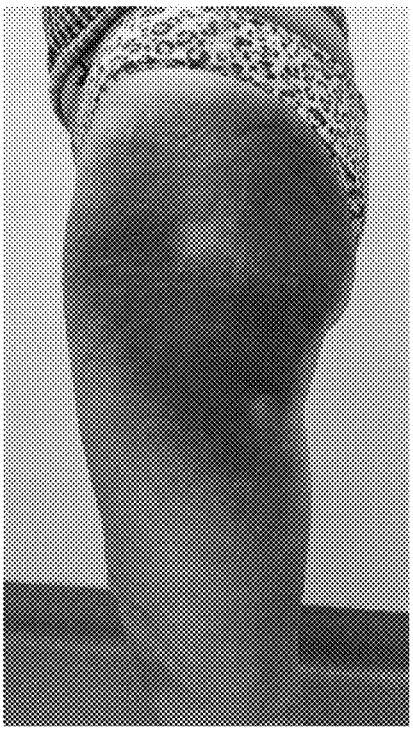
Prior Art Fig 3
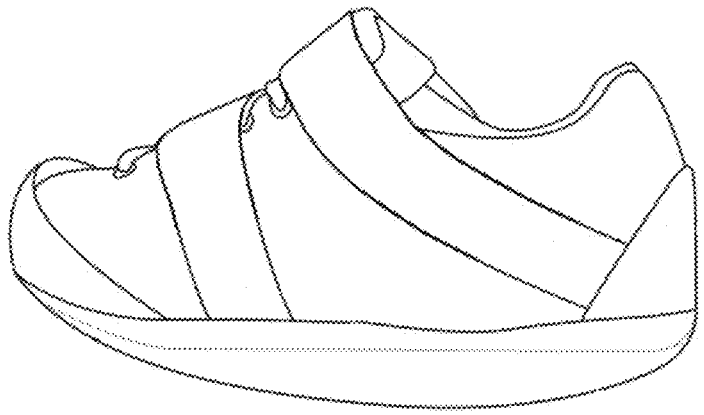
a)
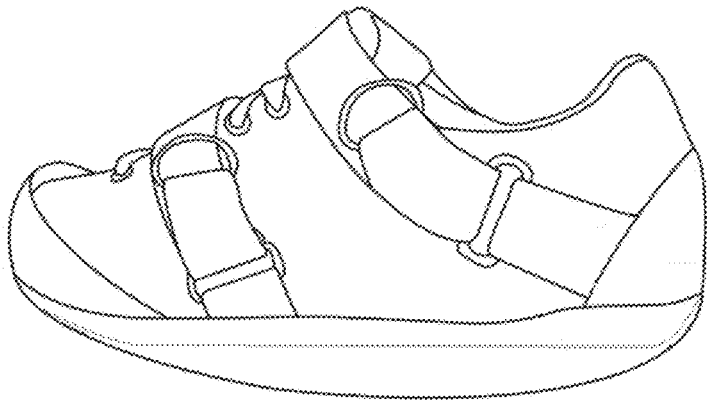
b)

Fig 5: An Overview of the Reverse-Pull Fastening on OWC 2 metal loops attach to the inside front of each OWC by using fabric tape to hold them in position

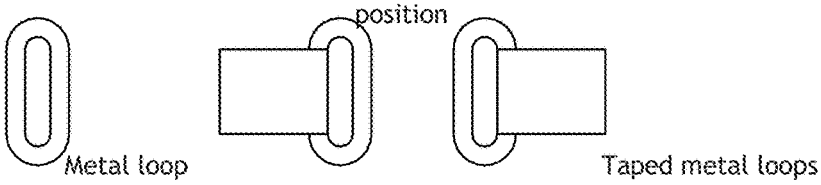

Then both sides of velcro are stitched along one side of fabric tape and attached across the OWC opposite the metal loops.

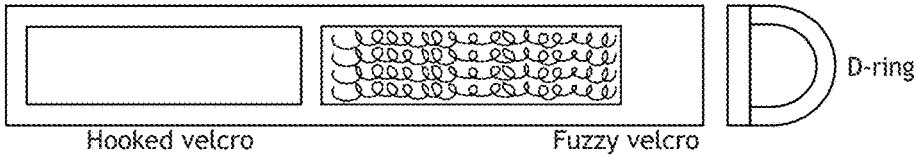

The velcro'd tape is then slotted through one metal loop before attaching a D-ring at the end.

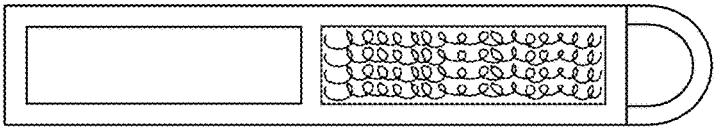

(The D-ring assists people unable to reach over to fasten the OWC device by using the hook on dressing stick instead of reaching over).

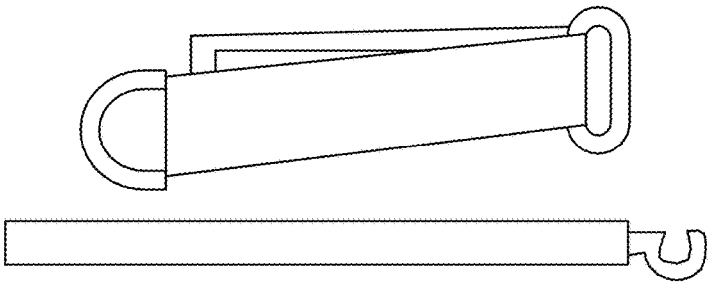

A dressing stick is a wooden dowel with a metal hook attached to the end for enabling independence in fastening the OWC device by hooking the loops at the end of the straps to open and close the device.

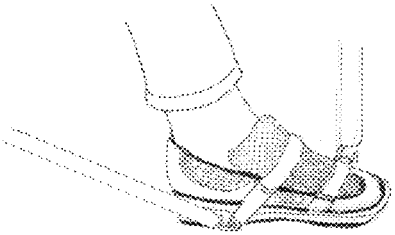

(Photographic demonstration of a dressing stick being used to fasten the reverse-pull fastening attached to my own shoes)

OVERSHOE WALKING CORRECTOR

BACKGROUND OF THE INVENTION

Field of the Invention

The present invention is a medical walking device to erase back pain in the gait of obese populations caused by incorrect motion in their feet, as their bodies are too heavy to move correctly. In addition, the walking device will speed up the rehabilitation process in orthopaedic lower limb trauma users, once weight bearing is permitted.

The current invention was designed by a retired Occupational Therapist who discovered the qualities of healing in the pendulum design, after falling onto concrete that severely bruised, but didn't break her left hip. The fall was saved by her daily dose of oral calcium, for strengthening her bones from potential falls off her bicycle.

But when the inventor tried to get out of bed the next morning, she was unable to weight bear on her left hip for standing, due to the severity of the bruise that had propagated overnight. The inventor knew she hadn't broken any bones, as she had limped home the previous day. But now the pain was quite unbearable to stand. She searched through all her shoes to see if any would allow her to stand without pain. No flat-soled shoes permitted standing, then she found a pair of rocker-based shoes that she had once purchased for analyzing the value of the rocker base in normal motion. At the time of their purchase, the inventor found the rocker base made no difference to normal gait and therefore continued using them as her usual footwear.

The inventor stood in the rocker shoes with a severely bruised and painful hip with only minimal pain. Immediately, the inventor understood the dynamic contribution the rocker base makes to gait, as there is no weight bearing capacity in the rocker-based movement, only continual motion. The inventor realized whom would benefit the most from this design and this is the obese population, who suffer back pain in gait as the movements in their lower limbs are incorrect.

In order to better understand the value of the rocker base, basic science is explained for enabling its contribution to correcting gait: Science describes the origins of motion through the rolling action of a circular shape that is seen in cars and bicycles. The human body is not able to use a full circle in the motion of the lower limbs. Instead, uses part of a circle—like eating a 'slice of pie', when we can't eat a whole pie! Science doesn't describe motion in slices, but as a pendulum that we envision in a grandfather clock passing time in second intervals.

This is how motion is formed in the human body, as the pendulum is contained in each lower limb skeletal joint for enabling gait. If you look sideways at a person walking, you will see the pendulum moves each individual leg joint and also in moving the whole leg in one pendulum motion. However, when motion is incorrect, such as after an injury, or in extreme weight gain—then motion must change to keep the body upright, balanced and safe.

In the obese population, gait causes back pain, as their body is telling them through pain that their movements aren't correct. They complain to their family physician about their back pain, but the doctors only tell them that if they lost their extra body weight, the pain would disappear.

This isn't what the obese want to hear, as weight loss is not an immediate solution taking time, discipline and a lifestyle change that gives them too much hardship and deprives them of their love of eating unhealthy foods. This unhealthy lifestyle results in a domino effect on their lives, as the less the obese move, the more back pain they suffer and the more weight they continue to gain, limiting their movements even more. A s this cycle continues to worsen, their medical health deteriorates putting a significant strain on their physical mobility, which in turn threatens their functional mobility, safety and independence.

The current invention will immediately erase the back pain the obese suffer in gait, as the pendulum motion is re-introduced back into the final articulation of their gait. This m ov em en t is the rolling action of their feet along the surface of the ground. If this concept is unclear to recognize, try carrying a very heavy load of over fifty pounds. Immediately you will struggle to walk with the extra load, as it is too heavy for your body to move correctly. Your base which are your legs need to widen to keep your body upright, balanced and safe. Now you cannot walk forwards normally, as you now need to keep your feet flat on the ground to prevent you from falling. Now you will feel back pain, as you aren't walking correctly in normal gait.

Description of Prior Art

US Patent No. 2011/0078923 A1 is a walking device containing "the structural integrity in the base for the purpose of normal motion of the foot in gait". This walking device replicates the normal motion used in gait for users to walk in comfort. However, the shape is not required for normal users in gait, as the human body already performs this action in the movement of their feet to create normal gait.

The overshoe is commonly used as an outer covering for protecting the user's current footwear from damage affected by: a) adverse weather conditions such as rain, sleet or snow or b) rough terrain, such as building sites with mud or concrete in the vicinity. Both need overshoes to protect their own footwear from these harsh elements. Other overshoe patents include unique styles and designs for specific uses in recreational and employment activities. In all the overshoe patents studied, they all contain flat soles for use with the normal weight population and there are no patents to deal with the changing of physical motion of normal gait in other cohorts.

The overshoe in this current design is used to change the shape in the base of the users' current shoes they are wearing into a pendulum shaped base, so the user can walk correctly without feeling any pain in gait.

SUMMARY OF THE INVENTION

An Overshoe Walking Corrector Device (OWC) being adjustable and configured to fit over any flat-soled footwear, the device comprising:

an overshoe base comprising;

an outsole having an upper and lower surface defining a continuously curved pendulum shape from front to back of the base overshoe such that an apex of the pendulum shape is located proximate a middle of the base overshoe;

a toe guard extending from said upper surface and located at a front of the base overshoe;

a heel guard extending from the said upper surface and located at a back of the base overshoe; and an adjustable plate fixed on said upper surface at a central point of the pendulum shape and having adjusting portions allowing the plate to adjust in both a length and a width direction such that the device is configured to accommodate different size of flat-soled footwear;

said adjustable plate having a raised lip extending around the outer edges thereof configured to prevent the footwear from slipping out during use; and a fastening portion attached to said base overshoe, comprising:

a top strap located at a medial location between the toe and heel guards configure to extend across a top portion of a user's footwear; and an ankle strap attached to the heel guard configured to extend around an ankle portion of a user's footwear.

The present walking device is a medical, rehabilitation tool for removing back pain to correct gait in the obese population. When they complain to their family physician about the back pain, the doctors inform them that if they do more exercise, the pain will go away.

The current device can be prescribed without any need for instructions in their use, as normal gait is a natural response in the human body. The goal is to empower physical and purposeful mobility in the obese population, as they perform more sedentary sitting and unhealthy eating than the normal weight population. The intention is to reduce the burden of illness and disease on the medical system in all western populations.

The present walking device is adjustable to fit over any flat-soled footwear, as many obese individuals require specialized footwear for protecting their feet from the medical symptoms of swelling and skin fraglity caused by their poor peripheral circulation, as physical motion is absent in their bodies. It means the current device will replace their own shoe base to change the way they walk, without needing to purchase another pair of shoes.

The current walking device is shaped like a sandal with a toe guard at the front and a heel guard shaped at the back along with a raised lip around the edge for preventing the foot and shoe/foot appliance from slipping off the device during gait There are two reverse-pull fastenings attached to each side of the device: one is fitted behind the toes, across the metatarsal bones, for holding the front of the foot and shoe/foot appliance in the device and the other strap connects to each side of the heel guard to hold the back of the foot and shoe/foot appliance around the ankle in the device. Both straps are easy to manage by the obese independently with the use of a dressing stick (a piece of wooden dowel with a hook attached to the end) that aids in reaching their feet for managing the fastening.

There is only one safety caution when first using the device. Users need to be prepared for the imbalance when first standing in the device, as the device is not flat like normal flat-soled shoes. Once this feature is understood and learned by the user, will be no further concerns in gait, as the body will naturally accustom to the imbalance in the base.

BRIEF DESCRIPTION OF PHOTOGRAPHS AND DRAWINGS

FIG. 1 are four photographs of the inventor's bruised hip taken over a few days to demonstrate the severity of the bruise that propagated following a fall onto concrete.

FIG. 3 are two drawings for viewing each side of the device, in-order to see the whole reverse-pull fastening attachment. This is described in more detail in the final section, as the obese suffer medical problems not usually experienced in the healthy populations.

The current walking device needs to be adjustable, as many obese sufferer's feet need protection from the medical symptoms of obesity, such as diabetes that causes swollen feet and skin trauma that are difficult to heal caused from immobility. These symptoms can be aided by using this device to increase physical mobility in gait, or else their symptoms will worsen leading to ulcers that will seriously jeopardize their overall medical and physical health and threaten their overall functional independence.

FIG. 5 shows the reverse-pull fastening used to hold the device tightly over their shoe/foot appliance and converts the base of the device into their own shoe/foot appliance base.

DETAILED DESCRIPTION OF THE INVENTION

References is made to the attached drawings with reference numbers and letters used to show the changes and the reason for the changes from the original patent of the first walking device. (Patent No: US 2011/0078023 Al, 2011)

The idea for the device began with FIG. 1 with four replacement photographs taken over several days, to show the severity of the bruise that occurred over the inventor's left hip following a fall that prevented her from weight bearing on her left hip for gait. In theory, the inventor should have been able to weight bear, as the hip wasn't broken, only bruised. But the pain from the bruise was so severe that mobility was impossible for gait.

Figure 2:
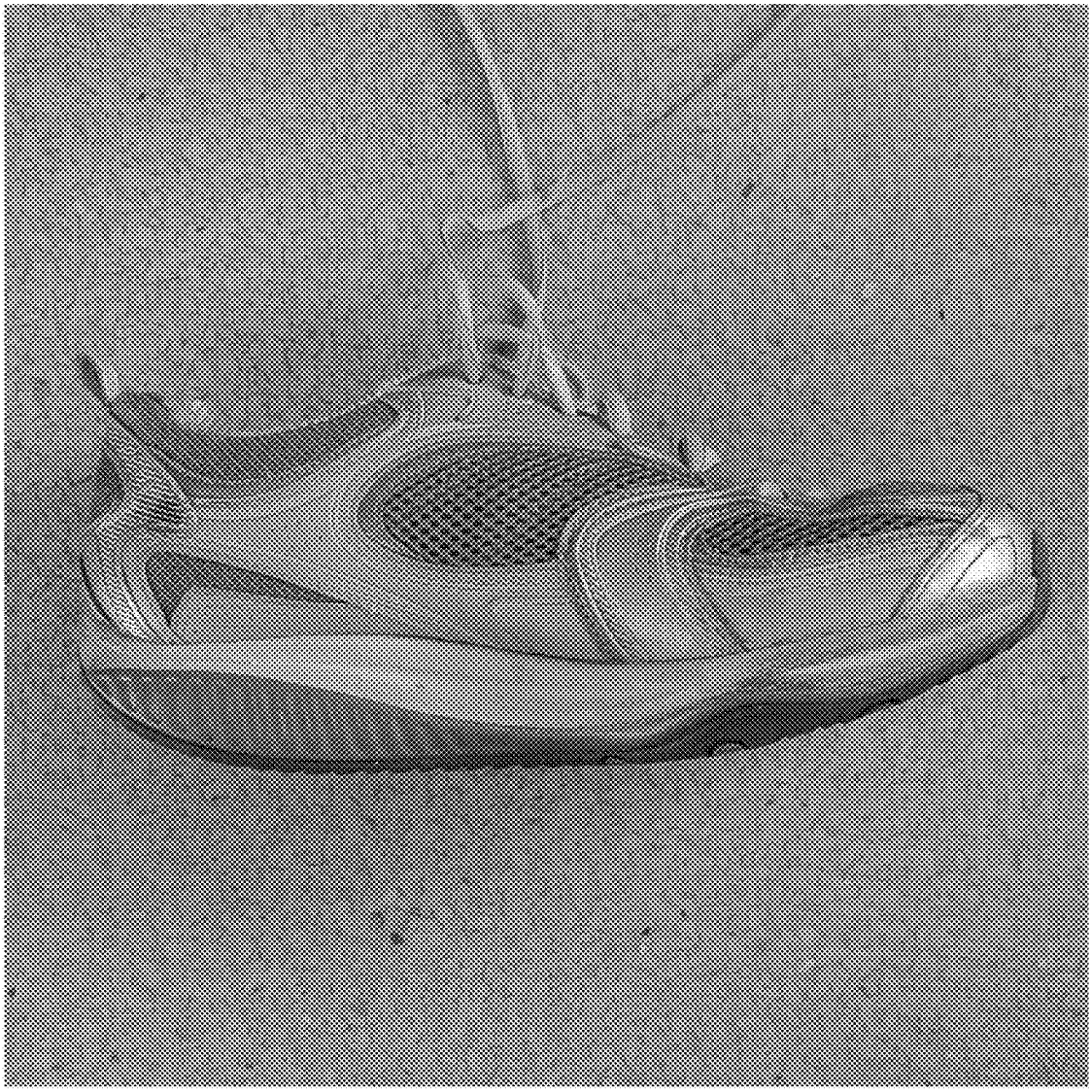
FIG. 2 is a photograph of the inventor's rocker shoe that were the only pair of shoes she was able to use for gait over the next three months, as the pain from the bruise was so severe.

FIG. 2 is a replacement sheet and photograph of the only shoes the inventor could wear throughout the time the bruise remained over her hip that was about three months. The shoes contain a pendulum in the base that may appear insignificant, but was enough to move the weight bearing pressure from static to one continuous motion to create comfortable and pain free gait.

FIG. 3 is a replacement sheet of the current walking device drawn to show each side of the device: a) is the inside of the view of the device and b) is the outside of the device showing the reverse-pull fastening.

Also on FIG. 3 are sequential numbering for explaining each part of the device:

Number 1 is the pendulum shape in the base and the purpose for designing the walking device. It is the most important element to this design for healing the back pain in obesity for gait. The original walking device cannot be used by the obese, as their feet will not safely fit into the original design for comfort, plus the obese cannot reach their feet to do up the shoe laces. Hence, this particular device is designed for considering the medical needs of obesity by allowing the user to wear their own specialized footwear, for overcoming the medical issues of obesity.

Number 2 is the adjustable foot plate, where the individual's shoe/foot appliance lies inside of the walking device and allows the balance of the user to remains upright and safe.

Number 3 is the toe guard on the front and number 4 is the heel guard at the back of the device. Both guards prevent the foot in the shoe/foot appliance from slipping out of the adjustable foot plate in gait.

Number 5 and 6 are the reverse-pull fastenings to hold the shoe/foot appliance tightly inside of the device, so the base of the device now becomes the base of their own shoes/foot appliance for gait. Number 5 is the strap closer to the toes and attaches behind the toes, or across the metatarsal bones and under the adjustable plate.

Number 6 attaches to the heel guard and holds the leg around the ankle, preventing the foot from slipping out of the walking device during the final stage of motion in gait. The foot in the shoe/foot appliance is now very secure to commence normal gait.

Number 7 is the adjustable plate that sits on top of the pendulum, in order to allow different sizes of shoe/foot appliances to to be accommodated. The adjustable plate has a raised lip around the edge that forms into the front and back guards to hold each foot inside the shoe/foot appliance securely. The plate is permanently fixed centrally to the pendulum, so the rest of the foot appliance securely. The plate is permanently fixed centrally to the pendulum, so the rest of the shape can accommodate different sizes of feet and footwear.

Number 8 is the flat-based shoe/foot appliance worn by the obese user, as their footwear are mostly specialized for protecting their fragile feet, due to their poor peripheral circulation from lack of movement in their bodies.

Figure 4:
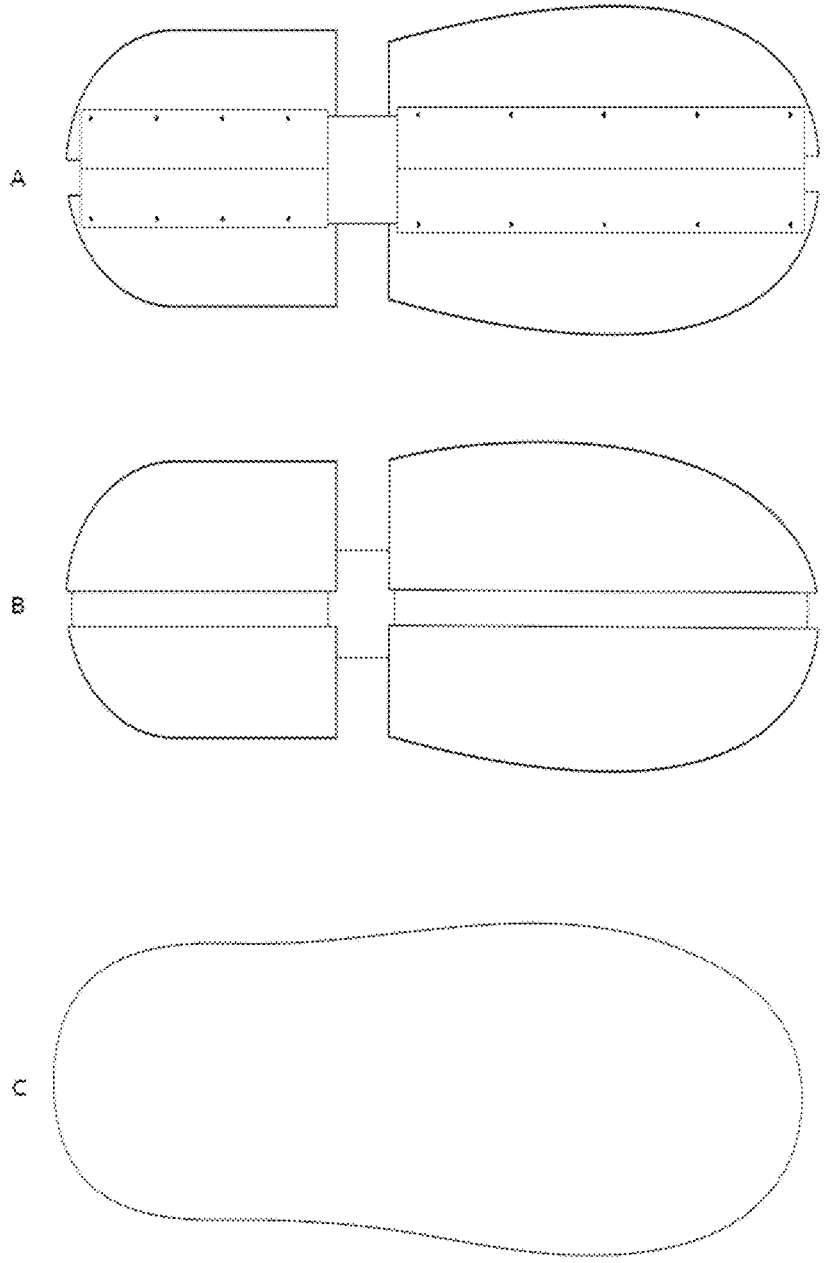
FIG. 4 is the adjustable part of the device with three views: a) Shows the view from under the foot and shoe/foot appliance that is sandwiched between the pendulum base and the shoe/foot appliance. b) Is a view from above looking down into the walking device, and c) is the same as the previous view, but with a cover over the top like any shoe covering.

FIG. 4 contains three diagrams of the adjustable plate from different views for understanding how adjustable it is. Section A is a view from underneath the base, to show how adjustable the plate becomes for accommodating different sizes of footwear. Section B is an overhead view of the plate with the adjustable parts hidden and Section C is the same as the previous view, but with a foot covering over the top like any normal shoe cover.

FIG. 4 sits on top of the pendulum base, in order to allow different sizes of shoes/foot appliances to be accommodated in the device. The adjustable plate has a raised lip around the edge forms into the front and back guards and holds each foot securely inside of each shoe/foot appliance on the plate. The plate is permanently fixed at a central point on the pendulum, so that the rest of the shape of the base will accommodate the different sizes of feet and footwear. The plate enables the user's footwear base to becomes. the base of the walking shoes without needing to purchase another pair of shoes for correcting gait.

FIG. 5 is a replacement sheet for the diagram of the two reverse-pull fastenings on each device and shows how the separate parts each make up the fastening, for enabling the obese to operate the fastening independently:

Line A shows one D-ring loop and two loops through small pieces of tape for attaching to the inside view of the device.

Line B is the tape with both sides of the velcro stitched to one side of a length of tape and a D-ring loop remaining unattached at the end. (The D-ring loop needs to be larger than the ring loops so that the tape cannot become be undone once opened).

Line C is the completed fastening, showing how the velcro'd tape needs to be threaded through the metal loop before attaching the D-ring loop, so it doesn't become fully undone.

Line D is there to explain the velcro'd tape needs be threaded through the D-ring FIRST before being attached and to makes the reverse-pull fastening on the device.

Line E is a dressing stick, which is a piece of wooden dowel with a hook attached to one end. This is simple aid for the obese to avoid reaching down over their body to fasten the device for gait. The metal hook on the the stick 'hooks' onto the loops at the end of the fastening, for opening and closing the device independently.

Line F is a photograph of the inventor using the reverse-pull fastening with a dressing stick stitched to her own shoes as an example. It is a typical fastening for users unable to reach their feet independently, due to obesity or lower limb trauma.

In summary, the current walking device is a medical rehabilitation treatment tool for erasing back pain in the obese population caused by incorrect physical mobility, along with too much sedentary sitting that causes back pain leading to weight gain and medical deterioration in their daily lives. By encouraging them to use this walking device in gait, the goal is to increase physical mobility that will reduce their medical symptoms of inactivity. It will also allow them to broaden their social networks and meet other people with similar goals for weight loss, leading to an increase in their health and well being. The device will also speed up the rehabilitation process in lower limb trauma victims, allowing a return to normal activities much sooner than is normally possible for comfort.

The invention claimed is:

1. An Overshoe Walking Corrector Device being adjustable and configured to fit over any flat-soled footwear, the device comprising:

an overshoe base comprising;

an outsole having an upper and lower surface defining a continuously curved pendulum shape from front to back of the base overshoe such that an apex of the pendulum shape is located proximate a middle of the overshoe base;

a toe guard extending from said upper surface and located at a front of the overshoe base;

a heel guard extending from the said upper surface and located at a back of the overshoe base; and an adjustable plate fixed on said upper surface at a central point of the pendulum shape and having adjusting portions allowing the plate to adjust in both a length and a width direction such that the device is configured to accommodate different sizes of flat-soled footwear;

said adjustable plate having a raised lip extending around the outer edges thereof configured to prevent the footwear from slipping out during use; and a fastening portion attached to said overshoe base, comprising:

a top strap located at a medial location between the toe and heel guards configure to extend across a top portion of a user's footwear; and an ankle strap attached to the heel guard configured to extend around an ankle portion of a user's footwear.

2. The Overshoe Walking Corrector device of claim 1, wherein the overshoe base further comprises a midsole with a heel arranged at a back of the mid sole.

* * * * *